US005401615A

United States Patent [19]

Pai et al.

[11] Patent Number: 5,401,615

[45] Date of Patent: Mar. 28, 1995

[54] OVERCOATING FOR MULTILAYERED ORGANIC PHOTORECEPTORS CONTAINING A STABILIZER AND CHARGE TRANSPORT MOLECULES

[75] Inventors: Damodar M. Pai, Fairport; Paul J. DeFeo, Sodus Point; Kathleen M. Carmichael, Williamson; Dale S. Renfer, Webster, all of N.Y.

[73] Assignee: Xerox Corporation, Stamford, Conn.

[21] Appl. No.: 261,653

[22] Filed: Jun. 17, 1994

Related U.S. Application Data

[63] Continuation of Ser. No. 997,974, Dec. 28, 1992, abandoned.

[51] Int. Cl.[6] ..... G03G 5/043; G03G 5/047

[52] U.S. Cl. ..... 430/59; 430/134

[58] Field of Search ..... 430/57, 58, 59, 134

[56] References Cited

U.S. PATENT DOCUMENTS

| | | | |
|---|---|---|---|
| 4,050,935 | 9/1977 | Limburg et al. | 96/1 PC |
| 4,281,054 | 7/1981 | Horgan et al. | 430/59 |
| 4,297,425 | 10/1981 | Pai et al. | 430/58 |
| 4,457,994 | 7/1984 | Pai et al. | 430/59 |
| 4,515,882 | 5/1985 | Mammino et al. | 430/58 |
| 4,599,286 | 7/1986 | Limburg et al. | 430/59 |

FOREIGN PATENT DOCUMENTS 1601245 10/1981 United Kingdom .

OTHER PUBLICATIONS

Derwent Publications Ltd., London, GB; AN 91-090010(13).

*Primary Examiner*—John Goodrow

[57] ABSTRACT

An electrophotographic imaging member fabricated by forming on a charge generating layer a first coating including charge transporting molecules dispersed in a solution of a first polymer binder dissolved in a first solvent, drying the coating to remove the solvent to form a substantially dry charge transport layer, forming on the charge transport layer a second coating including charge transporting molecules and a chemical stabilizer additive selected from the group consisting of a nitrone, isobenzofuran, hydroxyaromatic compound and mixtures thereof molecularly dispersed in an electrically inactive second polymer binder in a solution of a second polymer binder dissolved in a second solvent, the first polymer binder being insoluble in the second solvent, and drying the second coating to remove the second solvent to form a substantially dry overcoat layer. This electrophotographic imaging member may be utilized in an electrophotographic imaging process.

17 Claims, No Drawings

OVERCOATING FOR MULTILAYERED ORGANIC PHOTORECEPTORS CONTAINING A STABILIZER AND CHARGE TRANSPORT MOLECULES

This is a continuation of application Ser. No. 07/997,974, filed Dec. 28, 1992, now abandoned.

BACKGROUND OF THE INVENTION

This invention relates in general to electrophotographic imaging members and more specifically, to layered photoreceptor structures with overcoatings containing a stabilizer and charge transport molecules and process for making and using the photoreceptors.

Electrophotographic imaging members, i.e. photoreceptors, typically include a photoconductive layer formed on an electrically conductive substrate. The photoconductive layer is a good insulator in the dark so that electric charges are retained on its surface. Upon exposure to light, the charge is dissipated.

A latent image is formed on the photoreceptor by first uniformly depositing an electric charge over the surface of the photoconductive layer by one of any suitable means well known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductive not exposed to light retain their surface charge. The quantity of electric charge at any particular area of the photoconductive surface is inversely related to the illumination incident thereon, thus forming an electrostatic latent image.

The photodischarge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, and single layer photoconductors which perform both functions. These layers are formed on an electrically conductive substrate and may include an optional charge blocking and an adhesive layer between the conductive layer and the photoconducting layer or layers. Additionally, the substrate may comprise a non-conducting mechanical support with a conductive surface. Other layers for providing special functions such as incoherent reflection of laser light, dot patterns for pictorial imaging or subbing layers to provide chemical sealing and/or a smooth coating surface may be optionally be employed.

One common type of photoreceptor is a multilayered device that comprises a conductive layer, a blocking layer, an adhesive layer, a charge generating layer, and a charge transport layer. The charge transport layer can contain an active aromatic diamine molecule, which enables charge transport, dissolved or molecularly dispel seal in a film forming binder. This type of charge transport layer is described, for example in U.S. Pat. No. 4,265,990. Other charge transport molecules disclosed in the prior art include a variety of electron donor, aromatic amines, oxadiazoles, oxazoles, hydrazones and stilbenes for hole transport and electron acceptor molecules for electron transport. Another type of charge transport layer has been developed which utilizes a charge transporting polymer wherein the charge transporting moiety is incorporated in the polymer as a group pendant from the backbone of the polymer backbone or as a moiety in the backbone of the polymer. These types of charge transport polymers include materials such as poly(N-vinylcarbazole), polysilvlenes, and others including those described, for example, in U.S. Pat. Nos. 4,618,551, 4,806,443, 4,806,444, 4,818,650, 4,935,487, and 4,956,440. The disclosures of these patents are incorporated herein in their entirety.

Charge generator layers comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. The phthalocyanines exist in many crystal forms which have a strong influence on photogeneration.

One of the design criteria for the selection of the photosensitive pigment for a charge generator layer and the charge transporting molecule for a transport layer is that, when light photons photogenerate holes in the pigment, the holes be efficiently injected into the charge transporting molecule in the transport layer. More specifically, the injection efficiency from the pigment to the transport layer should be high. A second design criterion is that the injected holes be transported across the charge transport layer in a short time; shorter than the time duration between the exposure and development stations in an imaging device. The transit time across the transport layer is determined by the charge carrier mobility in the transport layer. The charge carrier mobility is the velocity per unit field and has dimensions of $cm^2$/volt sec. The charge carrier mobility is a function of the structure of the charge transporting molecule, the concentration of the charge transporting molecule in the transport layer and the electrically "inactive" binder polymer in which the charge transport molecule is dispersed. It is believed that the injection efficiency can be maximized by choosing a transport molecule whose ionization potential is lower than that of the pigment. However, low ionization potential molecules may have other deficiencies, one of which is their instability in an atmosphere of corona effluents. A copy quality defect resulting from the chemical interaction of the surface of the transport layer with corona effluents is referred to as "parking deletion" and is described in detail below.

Reprographic machines often utilize multilayered organic photoconductors and also employ corotrons or scorotrons to charge the photoconductors prior to imagewise exposure. During the operating lifetime of these photoconductors they are subjected to corona effluents which include ozone, various oxides of nitrogen etc. It is believed that some of these oxides of nitrogen are converted to nitric acid in the presence of water molecules present in the ambient operating atmosphere. The top surface of the photoconductor is exposed to the nitric acid during operation of the machine and photoconductor molecules at the very top surface of the transport layer are converted to what is believed to be the nitrated species of the molecules and these could form an electrically conductive film. However, during operation of the machine, the cleaning subsystem continuously removes (by wear) a region of the top surface thereby preventing accumulation of the conductive species. However, such is not the case when the machine is not operating (i.e. in idle mode) between two large copy runs. During the idle mode between long copy runs, a specific segment of the photoreceptor comes to rest (is parked) beneath a corotron that had been in operation during the long copy run. Although the high voltage to the corotron is turned off during the time period when the photoreceptor is parked, some effluents (e.g. nitric acid, etc.) continue to be emitted from the corotron shield, corotron housing, etc. This effluent emission is concentrated in the region of the stationary photoreceptor parked directly underneath the corotron. The effluents render that surface region electrically conductive. When machine operation is resumed for the next copy run, a loss of resolution, and even deletion, is observed in the affected region. Thus, the corona induced changes primarily occur at the surface region of the charge transport layer. These changes are manifested in the form of increased conductivity which results in loss of resolution of the final toner images. In the case of severe increases in conductivity, there can be regions of severe deletions in the images. This problem is particularly severe in devices employing the charge transport molecule N,N'-diphenyl-N,N'-bis(3-methylphenyl)-(1,1'-biphenyl)-4,4'-diamine represented by the following structural formula:

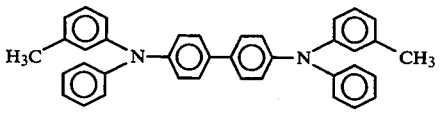

Thus, although the charge transport molecule meets most other electrophotographic criteria such as being devoid of traps, having high injection efficiency from many pigments, ease in synthesizing, and inexpensive, it encounters serious parking and other deletion problems when an idle mode is interposed between extended cycling runs.

INFORMATION DISCLOSURE STATEMENT

U.S. Pat. No. 4,599,286 to Limburg et al., issued Jul. 8, 1982 —An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 4,515,882 to Mammino et al, issued May 7, 1985 —An electrophotographic imaging system is disclosed which utilizes a member comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields.

U.S. Pat. No. 4,050,935 to Limburg et al., issued Sep. 27, 1977—A layered photosensitive member is disclosed comprising a generator layer of trigonal selenium and a transport layer of bis(4-diethylamino-2methylphenyl)-phenylmethane molecularly dispersed in a polymeric binder.

U.S. Pat. No. 4,457,994 to Pai et al. et al, issued Jul. 3 1984—A layered photosensitive member is disclosed comprising a generator layer and a transport layer containing a diamine type molecule dispersed in a polymeric binder and an overcoat containing triphenyl methane molecules dispersed in a polymeric binder.

U.S. Pat. No. 4,297,425 to Pai et al., issued Oct. 27, 1981—A layered photosensitive member is disclosed comprising a generator layer and a transport layer containing a combination of diamine and triphenyl methane molecules dispersed in a polymeric binder.

In copending application entitled "LAYERED PHOTORECEPTOR STRUCTURES WITH OVERCOATINGS CONTAINING A TRIPHENYL METHANE" Ser. No. 07/997,412, filed on Dec. 28, 1992 an electrophotographic imaging member is disclosed comprising a substrate, a charge generating layer, a charge transport layer comprising charge transporting molecules dispersed in a first polymer binder, and an overcoat layer comprising a triphenyl methane molecule dispersed in a second polymer binder, the second polymer binder being soluble in a solvent in which the first polymer binder is insoluble. The overcoat layer may contain an optional charge transport molecule. The device may also include any suitable optional charge blocking, adhesive and other sub layers. This electrophotographic imaging member is fabricated by forming on a charge generating layer a first coating comprising charge transporting molecules dispersed in a solution of a first polymer binder dissolved in a first solvent, drying the coating to remove the solvent to form a substantially dry charge transport layer, forming on the charge transport layer a second coating comprising triphenyl methane molecules and charge transporting molecules dispersed in a solution of a second polymer binder dissolved in a second solvent, the first polymer binder being insoluble in the second solvent, and drying the second coating to remove the second solvent to form a substantially dry overcoat layer. This electrophotographic imaging member may be utilized in an electrophotographic imaging process. The entire disclosure of this copending application is incorporated herein by reference.

Although acceptable images may be obtained when a chemical stabilizer selected from the group consisting of certain nitrone, isobenzofuran, hydroxyaromatic compounds and mixtures thereof are incorporated within the bulk of the charge transport layers, the photoreceptor can exhibit at least two deficiencies when subjected to extensive cycling. One is that the presence of the nitrone, isobenzofuran, hydroxyaromatic compounds and mixtures thereof in the bulk of the charge transport layer results in trapping of photoinjected holes from the generator layer into the transport layer giving rise to higher residual potentials. This can cause a condition known as cycle-up in which the residual potential continues to increase with multi-cycle operation. This can give rise to increased densities in the background areas of the final images. A second undesirable effect due to the addition of the nitrone, isobenzofuran, hydroxyaromatic compounds and mixtures thereof in the bulk of the transport layer is that some of these molecules migrate into the generator layer during the process of the :.fabrication of the transport layer. The presence of these stabilizers on the surface of the pigment in the generator layer could result in loss of sensitivity of the device. These two deficiencies limits the concentration of the nitrone, isobenzofuran, hydroxyaromatic compounds and mixtures thereof that can be added in the transport layer.

Where photoreceptors containing nitrone, isobenzofuran, hydroxyaromatic compounds and mixtures thereof in the charge transport layer are overcoated, intermixing of the overcoat and the transport layers occur which render the overcoat very ineffective. This intermixing leads to the incorporation of nitrone, isobenzofuran, hydroxyaromatic compounds and mixtures thereof in the bulk of the transport layer causing the aforementioned cycle-up. Also, the intermixing causes a reduction of the concentration of nitrone, isobenzofuran, hydroxyaromatic compounds and mixtures thereof on the outer surface of the photoreceptor. The concentration of nitrone, isobenzofuran, hydroxyaromatic compounds and mixtures thereof in the outer surface region of the photoreceptor prevents the aforementioned deletion.

Thus, there is a continuing need for photoreceptors having improved resistance to increased densities in the background areas of the final images, migration of additives into the generator layer during fabrication of the transport layer, and cyclic instabilities.

SUMMARY OF THE INVENTION

It is, therefore, an object of the present invention to provide an improved electrophotographic imaging member which overcomes the above-noted deficiencies.

It is yet another object of the present invention to provide an improved electrophotographic imaging member capable of reproducing extremely high resolution images.

It is still another object of the present invention to provide an improved electrophotographic imaging member having a surface region stable against loss of resolution.

It is another object of the present invention to provide an improved electrophotographic imaging member having a surface region stable against copy defects such as print deletion.

It is yet another object of the present invention to provide an improved electrophotographic imaging member having greater stability against corona effluents without an attendant reduction in transport efficiency of transport layers It is still another object of the present invention to provide an improved electrophotographic imaging member having greater stability against corona effluents without an attendant reduction of the sensitivity of the imaging member.

The foregoing objects and others are accomplished in accordance with this invention by providing an electrophotographic imaging member comprising a substrate, a charge generating layer, a charge transport layer comprising electrically active charge transporting molecules dissolved or molecularly dispersed in a first electrically inactive polymer binder, and an overcoat layer comprising charge transporting molecules and a chemical stabilizer additive selected from the group consisting of a nitrone, isobenzofuran, fused hydroxyaromatic compound, phenolic compound and mixtures thereof dissolved or molecularly dispersed in an electrically inactive second polymer binder, the second polymer binder being soluble in a solvent: in which the first polymer binder is insoluble. The device may also include any suitable optional charge blocking, adhesive and other sub layers. This electrophotographic imaging member is fabricated by forming on a charge generating layer a first coating comprising charge transporting molecules dispersed in a solution of a first polymer binder dissolved in a first solvent, drying the coating to remove the solvent to form a substantially dry charge transport layer, forming on the charge transport layer a second coating comprising charge transporting molecules and a chemical stabilizer additive selected from the group consisting of a nitrone, isobenzofuran, hydroxyaromatic compound and mixtures thereof molecule dissolved or molecularly dispersed in an electrically inactive second polymer binder in a solution of a second polymer binder dissolved in a second solvent, the first polymer binder being insoluble in the second solvent, and drying the second coating to remove the second solvent to form a substantially dry overcoat layer. This electrophotographic imaging member may be utilized in an electrophotographic imaging process.

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically nonconductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrode position. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may applied to the hole blocking layer. Any suitable adhesive layer well Known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating wire wound rod coating, gravure coating, Bird applicator coating, and the like. Drying of the deposited coating may be effected by any suitable conventional technique such as oven drying, infra red radiation drying, air drying and the like.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment a bout 8 percent by volume Of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as: oven drying, infrared radiation drying, air drying and the like.

The charge transport layer may comprise a charge transporting small molecule dissolved or molecularly dispersed in a film forming electrically inert polymer such as polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the generator layer to be transported across the transport layer. Typical charge transporting small molecules include, for example, pyrazolines such as 1-phenyl-3-(4'-diethylamino styryl)-5-(4''-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine represented by the formula:

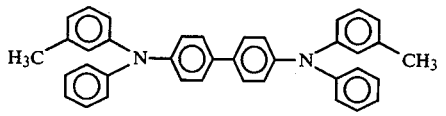

The electrically inert polymeric binder generally used to disperse the electrically active molecule in the charge transport layer is a poly(4,4'-isopropylidenediphenylene)carbonate (also referred to as bisphenol-A-polycarbonate) represented by the formula:

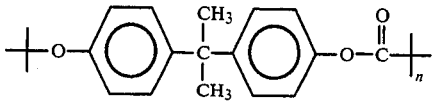

Any suitable electrically inactive resin binder insoluble in the solvent used to apply the overcoat layer may be employed in the charge transport layer of this invention. Typical inactive resin binders include polycarbonate resign, polyvinylcarbazole, polyester, polyarylate, polyacrylate, polyether, polysulfone, and the like. Molecular weights can vary, for example, from about 20,000 to about 150,000.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. In other words, the charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The overcoat layer of this invention comprises three principal components: (1) a polymeric film forming binder which is soluble in and coated from a solvent in which the charge transport layer film forming binder is insoluble, (2) an optional charge transporting monomer, and (3) a stabilizer selected from the group consisting of certain monomeric nitrone, isobenzofuran, hydroxyaromatic compounds and mixtures thereof. The choice of the film forming binder for the overcoat depends on the choice of the film forming binder for the transport layer. In a specific preferred embodiment, the charge transport layer binder is poly(4,4'-isopropylidenediphenylene) carbonate (i.e. bisphenol-A-polycarbonate), the overcoat film forming binder can be, for example, a poly(4,4'-cyclohexylidinediphenylene) carbonate (also referred to as bisphenol-Z-polycarbonate) having a structure represented by the following formula:

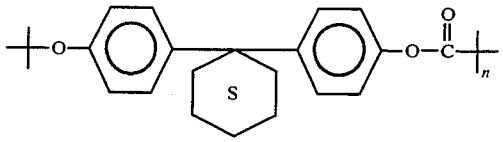

Bisphenol-Z-polycarbonate is soluble in and coated from toluene. The expression "soluble" as employed herein is defined as capable of forming a solution with which a film can be applied to a surface and dried to form a continuous coating. Bisphenol-A-polycarbonate is insoluble in toluene. The expression "insoluble" as employed herein is defined as not capable of forming a solution so that the solvent and the solid remain in two separate phases and a continuous coating cannot be formed. Molecular weights can vary, for example, from about 20,000 to about 150,000.

The charge transporting monomer (small molecule) in the overcoat layer can be any one of the aforementioned monomers employed to fabricate the transport layer.. In one embodiment the molecule in both the charge transport and overcoat layers is N,N'-diphenyl-N,N'-bis(3-methylphenyl)-(1,1'-biphenyl)-4,4'-di-amine.

The chemical stabilizer in the overcoat layer can be any one of several compounds described in U.S. Pat. No. 4,599,286, the entire disclosure thereof being incorporated herein by reference. In one embodiment, the stabilizer is a nitrone compound represented by the following generic structural formula:

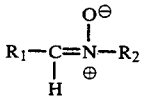

wherein $R_1$ is selected from the group consisting of a substituted and unsubstituted phenyl group, fused ring aromatic group and heterocyclic group, and $R_2$ is selected from the group consisting of a linear or branched alkyl group containing 1 to 20 carbon atoms, a fused ring aromatic group and a heterocyclic group. Typical nitrone compounds represented by this structural formula include, for example, t-butylphenylnitrone (also referred to as N-tert-butyl-alpha-phenylnitrone), i-propylphenylnitrone, 4-methylphenylphenylnitrone, t-butyl-4-methylphenylnitrone, and the like.

In another embodiment, the stabilizer is a isobenzofuran compound represented by the following generic structural formula:

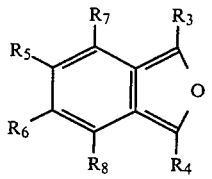

wherein $R_3$, $R_4$, $R_5$, $R_6$, $R_7$, and $R_8$ are independently selected from the group consisting of substituted and unsubstituted alkyl groups containing 1 to 10 carbon atoms and substituted and unsubstituted phenyl groups. Typical isobenzofuran compounds represented by this structural formula include, for example, diphenylisobenzofurans, dimethylisobenzofurans, diethylisobenzofurans, dipropylisobenzofurans, diisopropylisobenzofuran, dibutylisobenzofurans, disobutylisobenzofurans, diphenylisobenzofurans, alkyl substituted phenyl isobenzofurans in which the alkyl group contains from 1 to 4 carbon atoms, di(p-chlorophenyl)isobenzofuran, di(p-cyanophenyl)isobenzofuran, and the like.

In still another embodiment, the stabilizer is a fused hydroxyaromatic compounds represented by the following generic structural formula:

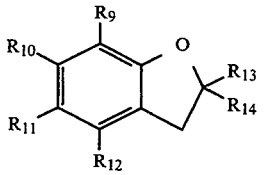

wherein $R_9$, $R_{10}$, $R_{11}$ and $R_{12}$ are independently selected from the group consisting of hydrogen, a hydroxyl group, an alkoxy group containing 1 to 6 carbon atoms and an alkyl group containing 1 to 6 carbon atoms, wherein at least one or said $R_9$, $R_{10}$, $R_{11}$ and $R_{12}$ is a hydroxyl group, and $R_{13}$ and $R_{14}$ are independently selected from hydrogen, an alkenyl group containing 3 to 40 carbon atoms and an alkyl group containing 1 to 40 carbon atoms.

In still another embodiment, the stabilizer is a monomeric or polymeric phenolic compound represented by the following generic structural formula:

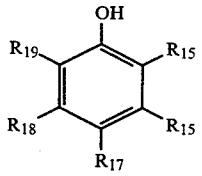

wherein $R_{15}$, $R_{16}$, $R_{18}$ and $R_{19}$ are independently selected from hydrogen, a hydroxyl group, and substituted and unsubstituted groups selected from the group consisting of a linear alkyl group containing 1 to 20 carbon atoms, a branched allyl group containing 1 to 20 carbon atoms, an alkenyl group containing 1 to 20 carbon atoms, a phenyl group, a napthyl group, and an alkoxy group containing 1 to 20 carbon atoms. Typical phenolic compounds include, for example, 2-tert-butyl-4-methoxyphenol, 2,6-di-t-butyl-4-methoxyphenol, hydroquinones, 2,6-di-tert-butyl-4-ethoxyphenol, 2,6-di-tert-butylphenol, 2,5-di-t-butyl-4-methoxyphenol, 2,6-di-t-butyl-p-cresol, 2,4,6-triphenol, erythrityl tetrakis [beta-(4-hydroxy-3,5-di-t-butylphenyl)propionate], and the like and mixtures thereof. Typical substituted and unsubstituted napthol compounds include 1-hydroxy-4-methyl-8-tert-butyl napthalene, 1-hydroxy-4-ehtyl-8-tert-butylnapthalene, 1-hydroxy-4-propyl-8-tert-butylnapthalene, 1-hydroxy-4-propoxy-8-tert-butylnapthalene, 1-hydroxy-4-butoxy-8-tert-butylnapthalene, 1-hydroxy-2-tert-butyl-4-methylnapthalene, 1-hydroxy-2-tert-butyl-4-ethylnapthalene, 1-hydroxy-2-tert-butyl-4-propylnapthalene, 1-hydroxy-2-tert-butyl-4-butylnapthalene, 1-hydroxy-2tert-butyl-4-methoxynapthalene, 1-hydroxy-2-tert-butyl-4-ethoxynapthalene, 1-hydroxy-2-tert-butyl-4-propoxynapthalene, 1-hydroxy-2-tert-butyl-4-butoxynapthalene, 1-hydroxy-2,8-di-tert-butyl-4-methylnapthalene, 1-hydroxy-2,8-ditert-butyl-4-ethylnapthalene, 1-hydroxy-2,8-di-tert-butyl-4-propylnapthalene, 1-hydroxy-2,8-di-tert-butyl-4-butylnapthalene, 1-hydroxy-2,8-di-tert-butyl-4-methoxynpahthalene, 1-hydroxy-2,8-di-tert-butyl-4-ethoxynapthalene, 1-hydroxy-2,8-di-tert-butyl-4-propoxynapthalene, 1-hydroxy-2,8-di-tert-butyl-4-butoxynapthalene, and the like and mixtures thereof.

Diphenylisobenzofuran, alpha-tocopherol, tetrakis [beta-(4-hydroxy-3,5-di-t-butylphenyl) propionate] (Irganox 1010), and tert-butylphenylnitrone are preferred stabilizers because they are non-toxic, stable at the temperatures normally employed during photoreceptor manufacture, soluble in the preferred transparent binders, readily available and inexpensive.

The concentration of the charge transporting molecules in the overcoat can be between about 5 percent by weight and about 50 percent by weight based on the total weight of the dried overcoat. The concentration of the chemical stabilizer of this invention in the overcoat can be between about 0.5 percent by weight and about 30 by weight based on the total weight of the dried overcoat. When less than about 0.5 percent by weight of stabilizer is present in the overcoat, the photoreceptor still exhibits considerable deletion. If the amount of stabilizer in the overcoat exceeds about 30 percent by weight, crystallization may occur resulting in residiual cycle-up. The total combined concentration of the charge transporting molecule and the stabilizer should be between about 5 percent by weight and about 50 percent by weight based on the total weight of the dried overcoat.

The thickness of the overcoat layer selected depends upon the abrasiveness of the cleaning system employed and can range from about 0.5 micrometer to about 10 micrometers in thickness. Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

The composition and materials employed in the overcoat layer must meet several requirements: (1) it should be charge transporting to prevent a residual build up across the overcoat, and (2) it should not intermix into the charge transport layer during the process of fabricating the overcoat. The second requirement can be met by the judicious selection of binders for the charge transport layer and the overcoat layers whereby the polymer binder for the overcoat is soluble in a solvent in which the polymer binder for the charge transport layer is insoluble.

Other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance for belt or web type photoreceptors. These anti-curl back coating layers are well known in the art and may comprise thermoplastic organic polymers or inorganic polymers that are electrically insulating or slightly semiconducting.

The photoreceptor of this invention may be used in any conventional electrophotographic imaging system. As described above, electrophotographic imaging usually involves depositing a uniform electrostatic charge on the photoreceptor, exposing the photoreceptor to a light image pattern to form an electrostatic latent image on the photoreceptor, developing the electrostatic latent image with electrostatically attractable marking particles to form a visible toner image, transferring the toner image to a receiving member and repeating the depositing, exposing, developing and transferring steps at least once. The serious parking and other deletion problems when an idle mode is interposed between extended cycling runs become especially pronounced when the depositing, exposing, developing and transferring steps are repeated at least 1,000 times in a single run, followed by resting of the photoreceptor between about 5 minutes and about 30 minutes, and repeating said depositing, exposing, developing and transferring steps at least 10 additional times in another single run.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Scanner Characterization

Each photoconductor device to be evaluated is mounted on a cylindrical aluminum drum substrate which is rotated on a shaft. The device is charged by a corotron mounted along:the periphery of the drum. The surface potential is measured as a function of time by capacitively coupled voltage probes placed at different locations around the shaft. The probes are calibrated by applying known potentials to the drum substrate. The devices on the drums are exposed by a light source located at a position near the drum downstream from the corotron. As the drum is rotated, the initial (pre exposure) charging potential is measured by voltage probe 1. Further rotation leads to the exposure station, where the photoconductor device is exposed to monochromatic radiation of known intensity. The device is erased by light source located at a position upstream of charging. The measurements made include charging of the photoconductor device in a constant current or voltage mode. The device is charged to a negative polarity corona. As the drum is rotated, the initial charging potential is measured by voltage probe 1. Further rotation leads to the exposure station, where the photoconductor device is exposed to monochromatic radiation of known intensity. The surface potential after exposure is measured by voltage probes 2 and 3. The device is finally exposed to an erase lamp of appropriate intensity and any residual potential is measured by voltage probe 4. The process is repeated with the magnitude of the exposure automatically changed during the next cycle. The photodischarge characteristics is obtained by plotting the potentials at voltage probes 2 and 3 as a function of light exposure. The charge acceptance and dark decay can also be measured in the scanner. However, the excess carried on the surface can cause surface conductivity resulting in loss of image resolution and, in severe cases, causes deletion.

Parking Deletion Test

A negative corotron is operated (with high voltage connected to the corotron wire) opposite a grounded electrode for several hours. The high voltage is turned off, and the corotron is placed (or parked) for thirty minutes on a segment of the photoconductor device being tested. Only a short middle segment of the device is thus exposed to the corotron effluents. Unexposed regions on either side of the exposed regions are used as controls. The photoconductor device is then tested in a scanner for positive charging properties for systems employing donor type molecules. These systems are operated with negative polarity corotron in the latent image formation step. An electrically conductive surface region (excess hole concentration) appears as a loss of positive charge acceptance or increased dark decay in the exposed regions (compared to the unexposed control areas on either side of the short middle segment) Since the electrically conductive region is located on the surface of the device, a negative charge acceptance scan is not affected by the corotron effluent exposure (negative charges do not move through a charge transport layer made up of donor molecules).

EXAMPLE II

A photoreceptor is prepared by forming coatings using conventional techniques on a substrate comprising a vacuum deposited titanium layer on a polyethylene terephthalate film. The first deposited coating is a siloxane barrier layer formed from hydrolyzed gamma aminopropyl triethoxy silane having a thickness of 100 angstroms. The second coating is an adhesive layer of polyester resin (PE 49,000®, available from E. I. dupont de Nemours & Co.) having a thickness of 50 angstroms. The next coating is a charge generator layer containing 35 percent by weight vanadyl phthalocyanine particles obtained by the process as disclosed in U.S. Pat. No. 4,771,133, dispersed in a polyester resin (Vitel PE100, available from Goodyear Tire and Rubber Co.) having a thickness of 1 micrometer. The next layer was a transport layer and was coated with a solution containing one gram of N,N'-diphenyl-N,N'-bis(3-methyl-phenyl)-(1,1'biphenyl)-4,4'-diamine and one gram of polycarbonate resin [poly(4,440 -isopropylidene-diphenylene carbonate, available as Makrolon® from Farbenfabricken Bayer A. G.] dissolved in 11.5 grams of methylene chloride solvent using a Bird coating applicator. The N,N'-diphenyl-N,N'-bis(3-methyl-phenyl)-(1,1'biphenyl)-4,4'-diamine is an electrically active aromatic diamine charge transport small molecule whereas the polycarbonate resin is an electrically inactive film forming binder. The coated device was dried at 80° C. for half an hour in a forced air oven to form a 25 micrometer thick charge transport layer. However, the excess carriers on the surface cause surface conductivity resulting in loss of image resolution and, in severe cases, causes deletion.

EXAMPLE III

A second photoreceptor device was coated as in Example II. It was thereafter coated with a 2 micrometer thick overcoat from a solution containing 0.9 gram of N,N'-diphenyl-N,N'-bis(3-methyl-phenyl)-(1,1'biphenyl)-4,4'-diamine, 0.1 gram of t-butylphenylnitrone and one gram of polycarbonate resin [poly(4,4'-cyclohexylidine-diphenylene carbonate] dissolved in 23 grams of toluene solvent using a Bird coating applicator. The device: was dried in forced air oven at 80° C. for 30 minutes.

EXAMPLE IV

A third device was coated as in Example II. It was thereafter coated with a 2 micrometer thick overcoat from a solution containing 0.9 gram of N,N'-diphenyl-N,N'-bis(3-methyl-phenyl)-( 1,1 'biphenyl)-4,4'-diamine, 0.1 gram of diphenylisobenzofuran and one gram of polycarbonate resin [poly(4,4'-cyclohexylidine-diphenylene carbonate], dissolved in 23 grams of toluene solvent using a Bird coating applicator. The device was dried in forced air oven at 80° C. for 30 minutes.

EXAMPLE V

A fourth device was coated as in Example II. It was thereafter coated with a 2 micrometer thick overcoat from a solution containing 0.9 gram of N,N'-diphenyl-N,N'-bis(3-methyl-phenyl)-(1,1'biphenyl)-4,4'-diamine, 0.1 gram of alpha-tocopherol and one gram of polycarbonate resin [poly(4,4'-cyclohexylidine-diphenylene carbonate], dissolved in 23 grams of toluene solvent using a Bird coating applicator. The device was dried in forced air oven at 80° C. for 30 minutes.

EXAMPLE VI

The four devices of Examples II, III, IV and V were evaluated for their sensitivity and cyclic stability properties in the scanner described in Example I. A slight increase in sensitivity was observed in the overcoated devices. This increase corresponded to the increase in thickness by two microns. The residual potential was equivalent ( 15 volts) for all four devices and no cycle-up was observed when cycled for 10,000 cycles in a continuous mode. The overcoat clearly did not introduce any deficiencies.

EXAMPLE VII

The four devices of Examples II, III, IV and V were evaluated for their deletion properties by the parking deletion test described in Example I. The corotron exposed region of the device in Example II (without the overcoat) was found to be very conductive (a loss of positive charge acceptance of 600 volts). The loss of positive charge acceptance of the overcoated devices in Examples III, IV and V was very slight, indicating that the surface region had been stabilized against corona induced conductivity increases.

Although the invention has been described with reference to specific preferred embodiments, it is not, intended to be limited thereto, rather those skilled in the art will recognize that variations and modifications may be made therein which are within the spirit of the invention and within the scope of the claims.

What is claimed is:

1. An electrophotographic imaging member comprising a substrate, a charge generating layer, a charge transport layer comprising electrically active charge transporting molecules dissolved or molecularly dispersed in a first electrically inactive polymer binder, and an overcoat layer comprising charge transporting molecules and a chemical stabilizer additive selected from the group consisting of a nitrone, isobenzofuran, fused hydroxyaromatic compound, phenolic compound and mixtures thereof molecularly dispersed in an electrically inactive second polymer binder, said second polymer binder being soluble in a solvent in which said first polymer binder is insoluble whereby the bulk of said charge transport layer is substantially free of said nitrone, isobenzofuran, fused hydroxyaromatic compound, phenolic compound and mixtures thereof.

2. An electrophotographic imaging member according to claim 1 wherein said first polymer binder is poly(4,4'-isopropylidine-diphenylene carbonate.

3. An electrophotographic imaging member according to claim 1, wherein said second polymer binder is poly(4,4'-cyclohenylidinediphenylene) carbonate.

4. An electrophotographic imaging member according to claim 1 wherein said chemical stabilizer is a nitrone compound having the structural formula:

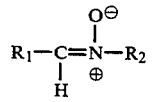

wherein $R^1$ is selected from the group consisting of a substituted and unsubstituted phenyl group, fused ring aromatic group and heterocyclic group, and $R^2$ is selected from the group consisting of a linear or branched alkyl group containing 1 to 20 carbon atoms, a fused ring aromatic group and a heterocyclic group.

5. An electrophotographic imaging member according to claim 1 wherein said chemical stabilizer has the structural formula:

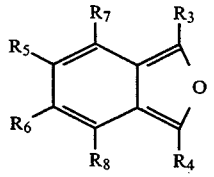

wherein $R_3$, $R_4$, $R_5$, $R_6$, $R_7$, and $R_8$ are independently selected from the group consisting of substituted and unsubstituted alkyl groups containing 1 to 10 carbon atoms and substituted and unsubstituted phenyl groups.

6. An electrophotographic imaging member according to claim 1 wherein said chemical stabilizer has the structural formula:

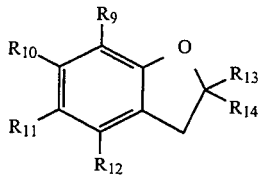

wherein $R_9$, $R_{10}$, $R_{11}$ and $R_{12}$ are independently selected from the group consisting of hydrogen, a hydroxyl group, an alkoxy group containing 1 to 6 carbon atoms and an alkyl group containing 1 to 6 carbon atoms, wherein at least one or said $R_9$, $R_{10}$, $R_{11}$ and $R_{12}$ is a hydroxyl group, and $R_{13}$ and $R_{14}$ are independently selected from hydrogen, an alkenyl group containing 3 to 40 carbon atoms and an alkyl group containing 1 to 40 carbon atoms.

7. An electrophotographic imaging member according to claim 1 in which said chemical stabilizer is a monomeric or polymeric phenolic compound having the structural formula:

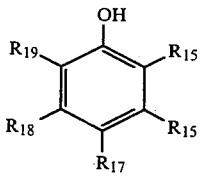

wherein $R_{15}$, $R_{16}$, $R_{18}$ and $R_{19}$ are independently selected from hydrogen, a hydroxyl group, and substituted and unsubstituted groups selected from the group consisting of a linear alkyl group containing 1 to 20 carbon atoms, a branched alkyl group containing 1 to 20 carbon atoms, an alkenyl group containing 1 to 20 carbon atoms, a phenyl group, a naphthyl group, and an alkoxy group containing 1 to 20 carbon atoms.

8. An electrophotographic imaging member according to claim 1 wherein the concentration of said charge transporting molecule in said overcoat layer is between about 5 percent and about 50 percent by weight based on the total weight of said overcoat layer.

9. An electrophotographic imaging member according to claim 1 wherein the concentration of said chemical stabilizer additive in said overcoat layer is between about 0.05 and about 10 percent by weight based on the total weight of said overcoat layer.

10. An electrophotographic imaging member according to claim 1 wherein said charge transporting molecule in said transport layer is N,N'-diphenyl-N,N'-bis(3-methyl-phenyl)-(1,1'biphenyl)-4,4'-diamine.

11. An electrophotographic imaging member according to claim 1 wherein said charge transporting molecule in said overcoat layer is N,N'-diphenyl-N,N'-bis(3-methyl-phenyl)-(1,1'biphenyl)-4,4'-diamine.

12. An electrophotographic imaging member according to claim 1 wherein said overcoat layer has a thickness between about 0.5 micrometer and about 10 micrometers.

13. An electrophotographic imaging member according to claim 1 wherein said charge transport layer has a thickness of between about 5 micrometers and about 50 micrometers.

14. An imaging process comprising providing an electrophotographic imaging member comprising a substrate, a charge generating layer, a charge transport layer comprising electrically active charge transporting molecules dissolved or molecularly dispersed in a first electrically inactive polymer binder, and an overcoat layer having an outer surface comprising charge transporting molecules and a chemical stabilizer additive selected from the group consisting of a nitrone, isobenzofuran, fused hydroxyaromatic compound, phenolic compound and mixtures thereof molecularly dispersed in an electrically inactive second polymer binder, said second polymer binder being soluble in a solvent in which said first polymer binder is insoluble whereby the bulk of said charge transport layer is substantially free of said nitrone, isobenzofuran, fused hydroxyaromatic compound, phenolic compound and mixtures thereof, depositing a uniform electrostatic charge on the outer surface of said overcoating layer with a corona charging device, exposing said imaging member to a light image pattern to form an electrostatic latent image on the outer surface of said overcoating layer, developing said electrostatic latent image with electrostatically attractable marking particles to form a visible toner image, transferring said toner image to a receiving member and repeating said depositing, exposing, developing and transferring steps at least once.

15. An imaging process according to claim 14 including repeating said depositing, exposing, developing and transferring steps at least 1,000 times in a single run, resting said imaging member between about 5 minutes and about 30 minutes, and repeating said depositing, exposing, developing and transferring steps at least 10 additional times in another single run.

16. A process for fabricating an electrophotographic imaging member comprising providing a substrate coated with a charge generating layer, forming on said charge generating layer a first coating comprising charge transporting molecules dispersed in a solution of a first polymer binder dissolved in a first solvent, drying: said coating to remove said first solvent to form a substantially dry charge transport layer, forming on said charge transport layer a second coating comprising charge transporting molecules and a chemical stabilizer additive selected from the group consisting of a nitrone, isobenzofuran, fused hydroxyaromatic compound, phenolic compound and mixtures thereof molecularly dispersed in an electrically inactive second polymer binderin a solution of a second polymer binder dissolved in a second solvent, said first polymer binder being insoluble in said second solvent, and drying said second coating to remove said second solvent to form a substantially dry overcoat layer.

17. A process for fabricating an electrophotographic imaging member according to claim 16 wherein said first coating is substantially free of said chemical stabilizer additive.

* * * * *